US011772408B2

(12) United States Patent
Tsukada et al.

(10) Patent No.: US 11,772,408 B2
(45) Date of Patent: Oct. 3, 2023

(54) IMAGE FORMING SYSTEM

(71) Applicant: CANON KABUSHIKI KAISHA, Tokyo (JP)

(72) Inventors: Yoshiro Tsukada, Chiba (JP); Shohei Okumura, Tokyo (JP); Kota Mori, Chiba (JP); Kenichiro Kitajima, Ibaraki (JP); Tohru Nakaegawa, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 97 days.

(21) Appl. No.: 17/498,847

(22) Filed: Oct. 12, 2021

(65) Prior Publication Data

US 2022/0134795 A1 May 5, 2022

(30) Foreign Application Priority Data

Nov. 2, 2020 (JP) ..... 2020-183686

(51) Int. Cl.
*B42D 25/46* (2014.01)
*B42D 25/455* (2014.01)
*B42D 15/08* (2006.01)

(52) U.S. Cl.
CPC ..... *B42D 25/46* (2014.10); *B42D 15/085* (2013.01); *B42D 25/455* (2014.10)

(58) Field of Classification Search
CPC ..... B65B 25/14; B42D 15/02; B42D 25/46; B42D 25/455; G03G 8/00; G03G 15/00; G03G 15/5029; B65H 35/0006; B65H 35/0046; B65H 37/04; B65H 37/06; B65H 2401/13; B65H 2801/27; B65H 2301/43827; B65H 2301/5114; B65H 2301/5162
(Continued)

(56) References Cited

U.S. PATENT DOCUMENTS 8,393,372 B2 * 3/2013 Yamauchi ..... B65H 37/04 156/387
9,552,538 B2 1/2017 Saiki
(Continued)

FOREIGN PATENT DOCUMENTS

CN 103870218 A 6/2014
CN 104423204 A 3/2015
(Continued)

OTHER PUBLICATIONS

Office Action dated Mar. 21, 2023, in Chinese Patent Application No. 202111259464.0.
(Continued)

*Primary Examiner* — Leslie A Nicholson, III
(74) *Attorney, Agent, or Firm* — Venable LLP

(57) ABSTRACT

An image forming system includes an image forming apparatus, a pressure sealing processing apparatus, and a control unit. The control unit is configured to permit execution of the pressure sealing processing process by the pressure sealing processing apparatus on a recording material of which a grammage is smaller than a predetermined grammage, and is configured not to permit execution of the pressure sealing processing process by the pressure sealing processing apparatus on a recording material of which a grammage is equal to or more than the predetermined grammage.

19 Claims, 10 Drawing Sheets

(58) Field of Classification Search
USPC ..... 270/58.08, 58.09
See application file for complete search history.

(56) References Cited

U.S. PATENT DOCUMENTS

| | | | | |
|---|---|---|---|---|
| 9,676,582 | B2 * | 6/2017 | Wakabayashi | B65H 37/04 |
| 9,897,959 | B2 | 2/2018 | Saito et al. | |
| 9,977,388 | B2 | 5/2018 | Saiki | |
| 10,185,265 | B2 | 1/2019 | Chiyoda | |
| 10,303,099 | B2 | 5/2019 | Chiyoda | |
| 10,345,750 | B2 | 7/2019 | Saito et al. | |
| 11,261,043 | B2 * | 3/2022 | Suzuki | B32B 37/142 |
| 11,487,228 | B2 * | 11/2022 | Kurata | G03G 15/5029 |
| 2010/0314049 | A1 | 12/2010 | Yamauchi et al. | |
| 2014/0168699 | A1 | 6/2014 | Morita | |
| 2015/0062634 | A1 * | 3/2015 | Saiki | H04N 1/00068 358/1.15 |
| 2018/0074449 | A1 * | 3/2018 | Chiyoda | G03G 21/1685 |
| 2021/0387467 | A1 * | 12/2021 | Asano | B65H 37/04 |

FOREIGN PATENT DOCUMENTS

| | | | |
|---|---|---|---|
| CN | 105700311 | A | 6/2016 |
| CN | 107817666 | A | 3/2018 |
| JP | 2009-051140 | A | 3/2009 |
| JP | 2012-101923 | A | 5/2012 |
| JP | 2015-096296 | A | 5/2015 |
| JP | 2017-074710 | A | 4/2017 |

OTHER PUBLICATIONS

Search Report dated Mar. 2, 2022, in European Patent Application No. 21203630.5.

* cited by examiner

FIG.6

WARNING

NON-HANDLED SHEET IS SELECTED FOR PRESSURE-FIT POSTCARD PROCESSING. THERE IS POSSIBILITY THAT PROCESSING CANNOT BE NORMALLY PERFORMED, BUT DO YOU WANT TO EXECUTE PRINTING?

SELECTED MEDIA: PLAIN SHEET

NON-HANDLED PROCESSING MACHINE: VANISH PROCESSING MACHINE

PRINTING AND PROCESSING EXECUTION | PRINTING ONLY EXECUTION | CANCEL

FIG.7

ERROR

NON-HANDLED SHEET IS SELECTED FOR PRESSURE-FIT POSTCARD PROCESSING. SINCE THERE IS POSSIBILITY THAT PROCESSING CANNOT BE NORMALLY PERFORMED, ONLY PRINTING IS PERFORMED WITHOUT PERFORMING PROCESSING.

SELECTED MEDIA: PLAIN SHEET

NON-HANDLED PROCESSING MACHINE: VANISH PROCESSING MACHINE

OK

FIG.8

ERROR

NON-HANDLED SHEET IS SELECTED FOR PRESSURE-FIT POSTCARD PROCESSING. SINCE THERE IS POSSIBILITY THAT PROCESSING CANNOT BE NORMALLY PERFORMED, PRINTING OPERATION IS STOPPED.

SELECTED MEDIA: PLAIN SHEET

NON-HANDLED PROCESSING MACHINE: VANISH PROCESSING MACHINE

OK

IMAGE FORMING SYSTEM

BACKGROUND OF THE INVENTION

Field of the Invention

The present invention relates to an image forming system capable of creating a pressure-seal printed matter by forming an image on a recording material, folding the recording material on which the image is formed, applying pressure to the folded recording material, and pressure-sealing the recording material.

Description of the Related Art

An apparatus that creates a pressure-seal printed matter excellent in information confidentiality has been proposed hitherto (JP 2015-96296 A). Examples of the pressure-seal printed matter include a pressure-seal postcard in which personal information cannot be read until a pseudo-bonded surface is peeled off by superimposing and pseudo-bonding a surface on which personal information or the like is formed as an image. The pseudo bonding mentioned herein is an aspect of bonding that can be peeled off after bonding and is difficult to re-bonded after peeling.

Examples of a method for performing the pseudo bonding include a paste method, a varnish method, and a film method. The paste method is a method for bonding a recording material by applying a heat-sensitive paste to the recording material and applying pressure to the recording material. The varnish method is a method for bonding a recording material by applying an ultraviolet-curable varnish to the recording material, irradiating the recording material with ultraviolet rays, and applying pressure to the recording material. The film method is a method for bonding a recording material by inserting a heat-sensitive bonding film between superimposed surfaces and then applying heat and pressure to the recording material.

As described above, in order to create the pressure-seal printed matter, it is necessary to pressure-seal the recording material by applying pressure or heat and pressure to the recording material. In this case, a bonding force is easily affected by the magnitude of the heat or pressure applied to the recording material. In a case where the bonding force is weak, unintended peeling may occur. On the other hand, in a case where the bonding force is strong, a layer other than the bonded surface is peeled off at the time of peeling, and thus, there is a concern that the image is transferred from one surface to the other surface. Thus, in order to perform the pseudo bonding with an appropriate bonding force, the magnitude (for example, a temperature of the heater, a pressurizing force of a pressure sealing roller, and the like) of the heat or pressure applied to the recording material is changed in accordance with a type of the recording material or the like hitherto.

Incidentally, in recent years, there has been proposed an image forming system that realizes so-called on-demand printing by connecting a post-process apparatus to an image forming apparatus that forms an image on a recording material and continuously performing processes from image formation on the recording material to a post-process without interruption. Thus, as the post-process apparatus, it is considered to connect an apparatus (hereinafter, referred to as a pressure sealing processing apparatus) that creates the pressure-bonded printed matter described above. In the image forming apparatus in such an image forming system, images can be generally formed on various types of recording materials. However, the recording material on which the image can be formed by the image forming apparatus is not necessarily a recording material that can be pressure-seal by the pressure sealing processing apparatus. In a case where a recording material that cannot be pressure-seal by the pressure sealing processing apparatus is conveyed, there is a possibility that an error, a pressure sealing failure, or the like occurs in the pressure sealing processing apparatus and the entire system including the image forming apparatus is stopped. Accordingly, even though the pressure sealing processing apparatus is connected to the image forming apparatus, since a user needs to manually set recording materials separately, it takes time and effort, and it is troublesome hitherto. Thus, the improvement of work efficiency for creating the pressure-seal printed matter cannot be expected.

SUMMARY OF THE INVENTION

In view of the above problems, the present invention provides an image forming system in which a user can easily perform a series of processes from image formation to pressure sealing with a configuration in which a pressure sealing processing apparatus that applies pressure to a recording material and pressure-seals the recording material is connected to an image forming apparatus.

According to a first aspect of the present invention, an image forming system includes an image forming apparatus configured to form an image on a recording material, a pressure sealing processing apparatus configured to execute a pressure sealing processing process of pressure-sealing the recording material by folding the recording material on which the image is formed by the image forming apparatus and applying pressure to the folded recording material, and a control unit configured to control the image forming apparatus and the pressure sealing processing apparatus. The control unit is configured to permit execution of the pressure sealing processing process by the pressure sealing processing apparatus on a recording material of which a grammage is smaller than a predetermined grammage, and is configured not to permit execution of the pressure sealing processing process by the pressure sealing processing apparatus on a recording material of which a grammage is equal to or more than the predetermined grammage.

According to a second aspect of the present invention, an image forming system includes an image forming apparatus configured to form an image on a recording material, a pressure sealing processing apparatus that includes an application unit which applies varnish on the recording material on which the image is formed by the image forming apparatus, a folding unit that folds the recording material in a state in which a surface on which the varnish is applied by the application unit faces inward, and a pressure sealing unit that applies pressure to the folded recording material, and is configured to execute a pressure sealing processing process on the recording material on which the image is formed by the image forming apparatus, and a control unit configured to control the image forming apparatus and the pressure sealing processing apparatus. The control unit is configured to permit execution of the pressure sealing processing process by the pressure sealing processing apparatus on a recording material of which a surface is coated, and is configured not to permit execution of the pressure sealing processing process by the pressure sealing processing apparatus on a recording material of which a surface is not coated.

Further features of the present invention will become apparent from the following description of exemplary embodiments (with reference to the attached drawings).

BRIEF DESCRIPTION OF THE DRAWINGS

FIGS. 4A and 4B are diagrams illustrating recording material input screens, in which FIG. 4A illustrates a case where pressure sealing processing is not performed and FIG. 4B illustrates a case where pressure sealing processing is performed.

FIG. 6 is a view illustrating a warning screen.

FIG. 7 is a diagram illustrating a print execution screen.

FIG. 8 is a diagram illustrating a forced ending screen.

DESCRIPTION OF THE EMBODIMENTS

First Embodiment

Image Forming System

Hereinafter, the present embodiment will be described. First, an image forming system according to the present embodiment will be described with reference to FIG. 1. An image forming system 1X according to the present embodiment includes an image forming apparatus 100 capable of executing an image forming mode for forming toner images on a recording material S, and a pressure sealing processing apparatus 200 capable of executing a pressure sealing mode for performing pressure sealing on the recording material S on which an image is formed by the image forming apparatus 100. The pressure sealing processing apparatus 200 is a post-process unit that can be retrofitted to the image forming apparatus 100 for function expansion, and the image forming apparatus 100 and the pressure sealing processing apparatus 200 are coupled so as to be able to transfer the recording material S. The image forming system 1X conveys the recording material S on which the image is formed by the image forming apparatus 100 to the pressure sealing processing apparatus 200, and causes the pressure sealing processing apparatus 200 to pressure-seal the recording material S in a folded state. Thus, it is possible to create a pressure-seal printed matter such as a pressure-seal postcard.

Figure 1:
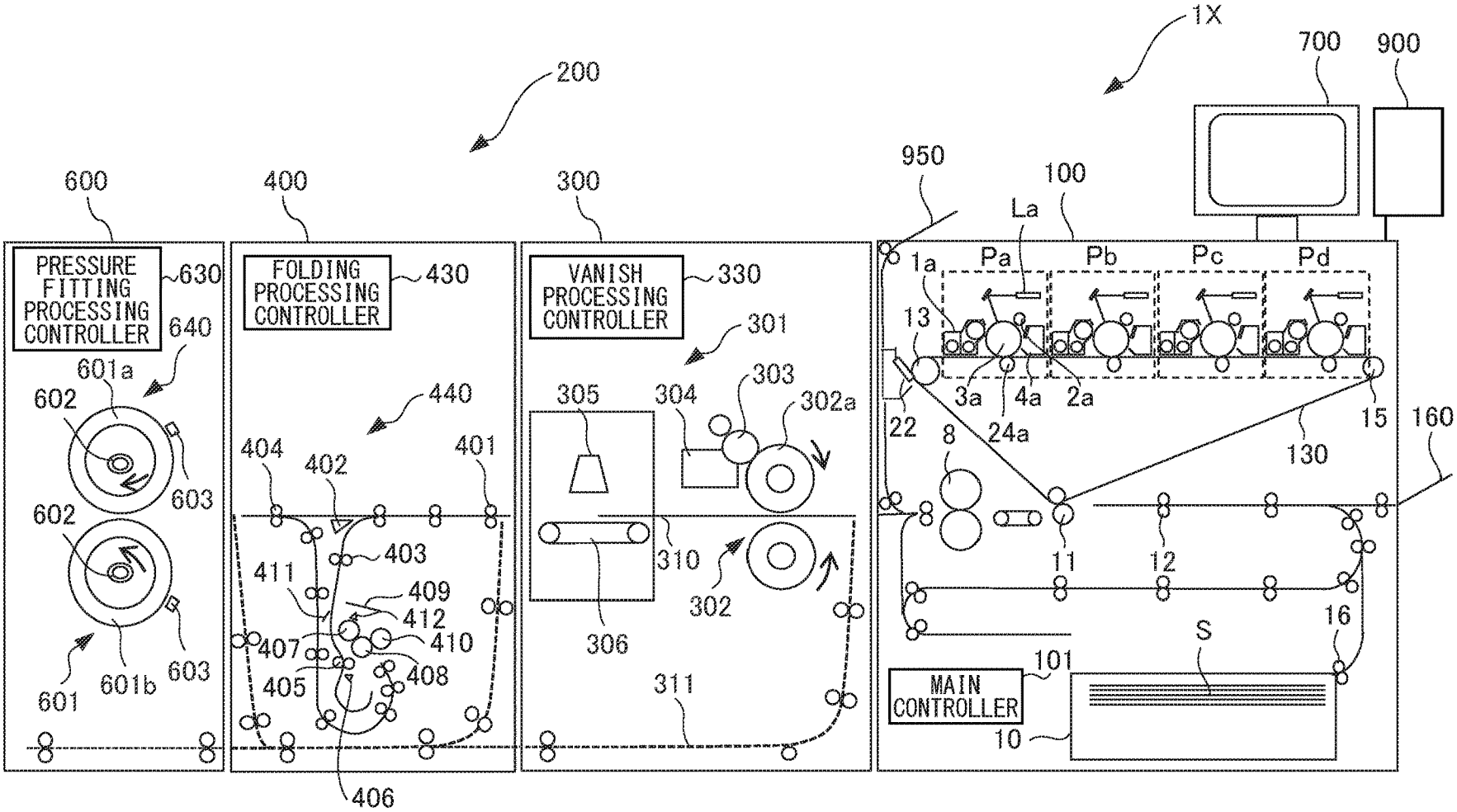
FIG. 1 is a schematic diagram illustrating an image forming system.

In FIG. 1, as the pressure sealing processing apparatus 200, an apparatus including an adhesive application device 300, a folding processing device 400, and a pressure sealing device 600 is illustrated as an example. The image forming apparatus 100, the adhesive application device 300, the folding processing device 400, and the pressure sealing device 600 are connected by a data input and output interface (not illustrated) capable of performing serial communication and parallel communication such that control signals, data, and the like can be transmitted and received therebetween.

Image Forming Apparatus

The image forming apparatus 100 will be described. The image forming apparatus 100 is a tandem full-color printer of an electrophotographic system. As illustrated in FIG. 1, the image forming apparatus 100 includes image forming units Pa, Pb, Pc, and Pd that form yellow, magenta, cyan, and black images, respectively. The image forming apparatus 100 forms the toner images on the recording material S in accordance with image signals from a document reading apparatus (not illustrated) connected to the apparatus body or an external device 900 such as a personal computer or an external controller connected to the apparatus body so as to be able to input and output data. As the recording material S, for example, a sheet material such as an uncoated sheet, a coated sheet, or a synthetic sheet that can be folded is used. The coated sheet is a recording material having high smoothness and formed by coating with a coating agent such as resin or clay, and the uncoated sheet is a recording material called a plain sheet or the like of which a surface is not coated.

As illustrated in FIG. 1, the image forming units Pa, Pb, Pc, and Pd are arranged side by side along a moving direction of an intermediate transfer belt 130 in the apparatus body. The intermediate transfer belt 130 is stretched around a plurality of rollers (13, 14, and 15) and rotated. The intermediate transfer belt 130 carries and conveys the toner images to be primarily transferred as will be described later. A secondary transfer outer roller 11 is disposed at a position facing a secondary transfer inner roller 14 stretching the intermediate transfer belt 130 with the intermediate transfer belt 130 interposed therebetween, and forms a secondary transfer portion for transferring the toner images on the intermediate transfer belt 130 to the recording material S. A fixing unit 8 is disposed downstream of the secondary transfer portion in a conveyance direction of the recording material.

A cassette 10 that houses the recording material S is disposed below the image forming apparatus 100. The recording material S is conveyed from the cassette 10 toward a registration roller 12 by a conveying roller 16. Thereafter, the registration roller 12 starts to rotate in synchronization with the toner images formed on the intermediate transfer belt 130, and thus, the recording material S is conveyed to the secondary transfer portion. A plurality of cassettes 10 is arranged so as to be able to house recording materials S having different sizes and thicknesses, and the recording material S selected by a user from among the plurality of cassettes 10 is conveyed. Not only the recording material S housed in the cassette 10 but also the recording material S placed on a manual feed tray 160 may be conveyed. As an option, the recording material S housed in a sheet feeding apparatus (not illustrated) connected as a casing different from the image forming apparatus 100 may be conveyed to the image forming apparatus 100.

The four image forming units Pa, Pb, Pc, and Pd included in the image forming apparatus 100 have substantially the same configuration except that the developed colors are different. Thus, the yellow image forming unit Pa will be described as a representative, and the illustration and description of the other image forming units Pb, Pc, and Pd will be omitted.

In the image forming unit Pa, a cylindrical photosensitive drum 3*a* is disposed as a photosensitive member. The photosensitive drum 3*a* is rotationally driven in a predetermined direction. A charging unit 2*a*, an exposing unit La, a developing unit 1*a*, a primary transfer roller 24*a*, and a drum cleaning unit 4*a* are disposed around the photosensitive drum 3*a*.

For example, a process of forming a full-color image by the image forming apparatus 100 will be described. First, in a case where an image forming operation is started, a surface of the rotating photosensitive drum 3*a* is uniformly charged by the charging unit 2*a*. The charging unit 2*a* is, for example, a corona charger that irradiates charged particles associated with a corona discharge to charge the photosensitive drum 3*a* to a uniform negative dark portion potential. Subsequently, the photosensitive drum 3*a* is scanned and exposed by a laser beam corresponding to image signals emitted from the exposing unit La. Accordingly, electrostatic latent images corresponding to the image signal are formed on the photosensitive drum 3*a*. The electrostatic latent images formed on the photosensitive drum 3*a* is developed into toner images that are visible images by a developer containing toner and a carrier housed in the developing unit 1*a*. In the present embodiment, the developing unit 1*a* uses, as a developer, a two-component developer containing a non-magnetic toner and a magnetic carrier.

The toner images formed on the photosensitive drum 3*a* are primarily transferred to the intermediate transfer belt 130 at a primary transfer portion formed between the photoconductive drum and the primary transfer roller 24*a* disposed with the intermediate transfer belt 130 interposed therebetween. At this time, a primary transfer bias is applied to the primary transfer roller 24*a*. The toner remaining on the surface of the photosensitive drum 3*a* after the primary transfer is removed by a drum cleaning unit 4*a*.

Such an operation is sequentially performed in the yellow, magenta, cyan, and black image forming units Pa to Pd, and toner images of four colors are superimposed on the intermediate transfer belt 130. Thereafter, the recording material S housed in the cassette 10 is conveyed to the secondary transfer portion in accordance with a forming timing of the toner image. The full-color toner images formed on the intermediate transfer belt 130 are secondarily transferred collectively to the recording material S by applying a secondary transfer bias to the secondary transfer outer roller 11. The toner remaining on the intermediate transfer belt 130 after the secondary transfer is removed by a belt cleaning unit 22.

The recording material S on which the toner images are formed is conveyed to the fixing unit 8. The fixing unit 8 heats and pressurizes the recording material S by nipping and conveying the recording material S on which the toner images are formed at a fixing nip portion formed by a pair of rollers, and fixes the toner images on the recording material S. Thereafter, the recording material S on which the toner images are fixed is conveyed to the pressure sealing processing apparatus 200. Alternatively, the recording material is discharged to a sheet discharge tray 950 as will be described later.

The image forming apparatus 100 includes a main controller 101. In the case of the present embodiment, the main controller 101 can execute, as a control unit, an image forming process of controlling the image forming apparatus 100 to form the images on the recording material S, and can execute a pressure sealing processing process of controlling the pressure sealing processing apparatus 200 to fold and pressure-seal the recording material S. A control configuration of such an image forming system 1X will be described later (see FIG. 2).

Next, the pressure sealing processing apparatus 200 will be described. As illustrated in FIG. 1, the pressure sealing processing apparatus 200 according to the present embodiment includes the adhesive application device 300 as an application unit, the folding processing device 400 as a folding unit, and the pressure sealing device 600 as a pressure sealing unit. The adhesive application device 300 applies a liquid adhesive to the surface of the recording material S on which the images are formed by the image forming apparatus 100. The folding processing device 400 folds the recording material S in a state in which the surface to which the liquid adhesive is applied. The pressure sealing device 600 applies heat and pressure to the folded recording material S. Hereinafter, the adhesive application device 300, the folding processing device 400, and the pressure sealing device 600 will be described.

Adhesive Application Device

First, the adhesive application device 300 will be described. In the present embodiment, an ultraviolet curable varnish (UV varnish) is adopted as a heat-sensitive liquid adhesive used for pseudo bonding of the recording material S in the adhesive application device 300. As long as the adhesive application device 300 can adjust the amount of the varnish to be applied to the recording material S, a method for applying the varnish to the recording material S may be an appropriate method such as a roller application method for applying the varnish by an application roller or an inkjet method for discharging the varnish from a nozzle and applying the varnish. In the present embodiment, a roller application method (also referred to as a roll coater type) is used.

The adhesive application device 300 includes a varnish processing controller 330 and a varnish application unit 301 that applies the varnish to the recording material S and dries the recording material S. The varnish processing controller 330 mainly controls the varnish application unit 301. The varnish application unit 301 includes an application roller pair 302 for applying the varnish, a supply roller 303 for supplying the varnish to the application roller pair 302, a varnish storage unit 304 for storing the varnish, a drying unit 305 for drying the varnish, and a conveyor belt 306 for conveying the recording material S.

The application roller pair 302 applies the varnish to one surface (referred to as a varnish-applied surface for the sake of convenience) of the recording material S while nipping and conveying the recording material S conveyed from the image forming apparatus 100. The varnish applied by the application roller pair 302 is supplied to one roller 302*a* of the application roller pair 302 by the supply roller 303. The supply roller 303 is movably provided at an abutment position at which the supply roller abuts on an outer peripheral surface of the roller 302*a* and supplies the varnish and a separated position where the supply roller is separated from the outer peripheral surface of the roller 302*a* and does not supply the varnish. The varnish storage unit 304 is a storage case for storing the varnish therein, and has an opening portion formed at a position higher than a liquid level. Since a part of the supply roller 303 enters the inside from the opening portion of the varnish storage unit 304 and is immersed in the varnish, the supply roller 303 can supply the varnish to the roller 302*a* while receiving the replenishment of the varnish from the varnish storage unit 304 by rotating. The varnish applied to the recording material S is dried by the drying unit 305. In the case of the present embodiment, the drying unit 305 irradiates the surface of the recording material S on which the varnish is applied with ultraviolet rays.

Note that the adhesive application device 300 includes, as a conveyance path of the recording material S, an application path 310 that applies the varnish to the recording material S and delivers the varnish to the subsequent folding processing device 400, and an application avoidance path 311 that delivers the recording material S to the subsequent folding processing device 400 without applying the varnish. Switching between the application path 310 and the application avoidance path 311 is performed by a flapper (not illustrated).

Folding Processing Device

Next, the folding processing device 400 will be described. The folding processing device 400 is a device that performs folding processing of folding the recording material S on which the image forming process is performed by the image forming apparatus 100 or the recording material S on which the image forming process and an adhesive application process by the adhesive application device 300. In the present embodiment, the folding processing device 400 of a roller pressure contact type capable of performing three-folding processing and two-folding processing has been described as an example. The folding processing device 400 includes a folding processing controller 430 and a folding unit 440 that folds the recording material S. The folding processing controller 430 mainly controls the folding unit 440.

The folding unit 440 will be described using the three-folding processing as an example. The recording material S conveyed from the adhesive application device 300 is drawn into a folder by an inlet roller pair 401, and is distributed to different conveyance paths by a branching flapper 402 in accordance with the necessity of the folding processing. That is, in a case where the folding processing is performed, the folding processing is distributed to a folding processing path toward a conveyance roller pair 403, and in a case where the folding processing is not performed, the folding processing is distributed to a folding avoidance path toward a sheet discharge roller pair 404.

In a case where the recording material S is distributed to the folding processing path, the recording material S is temporarily stopped at a position of a registration roller pair 405, and registration correction is performed by forming a loop. The recording material S on which the registration correction is performed is conveyed again, and first folding processing is performed on the recording material simultaneously when the recording material is drawn by a first folding roller 407 and a second folding roller 408 at a predetermined timing after passing through a folding position detection sensor 406. In a case where the drawn recording material S abuts against a folding abutment stopper 409, second folding processing is performed on the recording material simultaneously when the recording material is drawn by the second folding roller 408 and a third folding roller 410. The recording material S on which the second folding processing is performed is conveyed toward the sheet discharge roller pair 404 and is delivered to the subsequent pressure sealing device 600 by the sheet discharge roller pair 404. In a case where the recording material S is distributed to the folding avoidance path, the recording material is delivered to the subsequent pressure sealing device 600 by the sheet discharge roller pair 404 without performing the above-described three-folding processing.

The folding unit 440 will be described using the two-folding processing as an example. In a case where the recording material S is distributed to the folding processing path, the registration correction is performed on the recording material S similarly to the case of the above-described three-folding processing, and is conveyed again. The first folding processing is performed simultaneously when the recording material is drawn by the first folding roller 407 and the second folding roller 408. In the case of the two-folding processing, in a case where a trailing edge of the recording material S abuts against a trailing edge abutment stopper 411 after passing through the folding position detection sensor 406, the folding processing is performed simultaneously when the recording material is drawn by the first folding roller 407 and the second folding roller 408. At this time, the drawn recording material S is drawn by the second folding roller 408 and the third folding roller 410 by being guided by a leading edge guide 412 moved to a predetermined position in advance. The recording material S drawn into the second folding roller 408 and the third folding roller 410 is conveyed toward the sheet discharge roller pair 404 and is delivered to the subsequent pressure sealing device 600 by the sheet discharge roller pair 404. In a case where the recording material S is distributed to the folding avoidance path, the recording material is delivered to the subsequent pressure sealing device 600 by the sheet discharge roller pair 404 without performing the above-described two-folding processing.

Pressure Sealing Device

Next, the pressure sealing device 600 will be described. The pressure sealing device 600 is a device that performs pressure sealing of pressure-sealing the recording material S on which the adhesive application process by the adhesive application device 300 and the folding processing process by the folding processing device 400 described above are performed. In the present embodiment, as an example, the pressure sealing device 600 of the roller pressure contact type capable of performing the pressure sealing of the recording material S by applying heat and pressure to the recording material S via a pressure sealing roller pair that nips and conveys the recording material S has been illustrated. The pressure sealing device 600 includes a pressure sealing processing controller 630 and a pressure sealing unit 640 that pressure-seals the recording material S. The pressure sealing processing controller 630 mainly controls the pressure sealing unit 640.

The pressure sealing unit 640 will be described. The pressure sealing unit 640 includes a pressure sealing roller pair 601 that rotates to nip and convey the recording material S, a heater 602 that heats the pressure sealing roller pair 601, and a thermistor 603 that detects a temperature of the pressure sealing roller pair 601. The pressure sealing roller pair 601 includes an upper roller 601*a* and a lower roller 601*b*, and the upper roller 601*a* and the lower roller 601*b* are maintained at a desired temperature by the heater 602 in accordance with to the temperature detected by the thermistor 603. The pressure sealing roller pair 601 can apply heat and pressure to the recording material S while nipping and conveying the recording material S in the folded state. Accordingly, the recording material S folded in a state in which the varnish-applied surface on which the varnish is applied faces inward is pseudo-bonded such that the varnish-applied surface is bonded by the varnish. Although an example in which the pressure sealing roller pair 601 according to the present embodiment performs temperature control so as to maintain a predetermined temperature, the pressure sealing roller pair may perform pseudo bonding by bonding the varnish-applied surface with the varnish only by pressure.

Control Configuration of Image Forming System

Next, control of an image forming system 1X will be described with reference to FIG. 2 while referring to FIG. 1. In the present embodiment, a case where the image forming apparatus 100 (specifically, the main controller 101) integrally manages operation commands for the pressure sealing processing apparatus 200 (the adhesive application device 300, the folding processing device 400, and the pressure sealing device 600) and controls these devices will be described as an example. Although various devices such as a motor and a power supply are connected in addition to those illustrated in FIG. 2, the illustration and description thereof are omitted here since these devices are not the gist of the invention.

Figure 2:
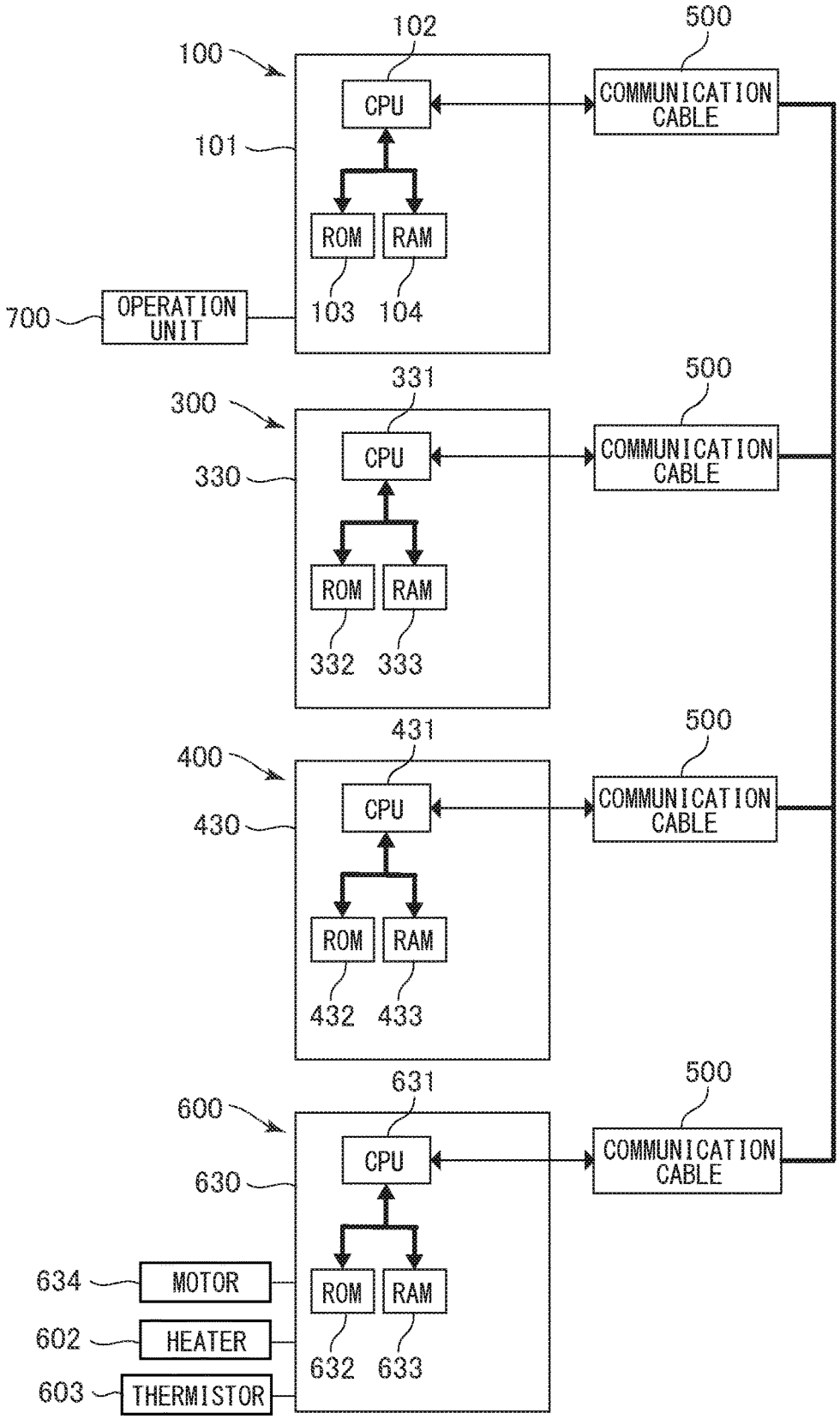
FIG. 2 is a control block diagram of the image forming system.

In the image forming system 1X according to the present embodiment, as illustrated in FIG. 2, the varnish processing controller 330, the folding processing controller 430, and the pressure sealing processing controller 630 are connected to the main controller 101 via a communication cable 500 so as to be able to communicate operation commands, various kinds of data, and the like. In accordance with the operation commands from the main controller 101, the varnish processing controller 330 operates the adhesive application device 300, the folding processing controller 430 operates the folding processing device 400, and the pressure sealing processing controller 630 operates the pressure sealing device 600. That is, the main controller 101 can control the entire image forming system 1X by transmitting the operation commands to the pressure sealing processing apparatus 200 (the adhesive application device 300, the folding processing device 400, and the pressure sealing device 600) while controlling the operation of the image forming apparatus 100.

The main controller 101, the varnish processing controller 330, the folding processing controller 430, and the pressure sealing processing controller 630 may have the same configuration. For example, each controller includes a central processing unit (CPU), a read only memory (ROM), and a random access memory (RAM).

The main controller 101 includes a CPU 102, a ROM 103, and a RAM 104. The ROM 103 and the RAM 104 store various programs such as an image forming process (not illustrated) and a pressure-seal printed matter creating process (see FIGS. 3 and 5) to be described later, and various kinds of data such as a pressure sealing processing table (see Tables 1 and 2). The RAM 104 can also temporarily store arithmetic operation processing results and the like accompanying the execution of various programs.

The image forming apparatus 100 includes, for example, an operation unit 700 having a liquid crystal display unit (see FIG. 1), and the operation unit 700 is connected to the main controller 101. The operation unit 700 as an input unit is a touch panel capable of displaying various screens presenting various programs, various kinds of data, and the like on a liquid crystal display unit and accepting start inputs of various programs, various data inputs, and the like in accordance with a screen touch operation by the user.

The user can input the start of "pressure-seal printed matter creation job" from the operation unit 700. In a case where "pressure-seal printed matter creation job" is input, the CPU 102 executes a pressure-seal printed matter creating process (program) stored in the ROM 103. Accordingly, the pressure sealing processing apparatus 200 (the adhesive application device 300, the folding processing device 400, and the pressure sealing device 600) can be operated together with the image forming apparatus 100. The user can also input the start of "image forming job" from the operation unit 700, and in this case, the CPU 102 executes an image forming process (program) stored in the ROM 103. However, in this case, the image forming apparatus 100 forms the images on the recording material S, but the pressure sealing processing apparatus 200 does not perform the pressure sealing of the recording material S.

The varnish processing controller 330 includes a CPU 331, a ROM 332, and a RAM 333. The CPU 331 operates the adhesive application device 300 based on a control program stored in the ROM 332. The folding processing controller 430 includes a CPU 431, a ROM 432, and a RAM 433. The CPU 431 operates the folding processing device 400 based on a control program stored in the ROM 432.

The pressure sealing processing controller 630 includes a CPU 631, a ROM 632, and a RAM 633. The CPU 631 operates the pressure sealing device 600 based on a control program stored in the ROM 632. A motor 634 that rotationally drives the pressure sealing roller pair 601, the heater 602 that heats the pressure sealing roller pair 601, and the thermistor 603 that detects the temperature of the pressure sealing roller pair 601 are connected to the pressure sealing processing controller 630. The pressure sealing processing controller 630 transmits a detection result (temperature data) of the thermistor 603 to the main controller 101. The pressure sealing processing controller 630 can change a temperature of the heater 602 by receiving a target temperature (data) from the main controller 101. The pressure sealing processing controller 630 can change a rotational speed of the motor 634 by receiving a target speed (data) of the recording material S conveyed from the main controller 101. Such target temperature and target speed vary depending on a type (the uncoated sheet, the coated sheet, or the like) of the recording material S, a grammage of the recording material S, and the like.

As described above, the pressure sealing processing apparatus 200 connected to the image forming apparatus 100 operates under the control of the main controller 101. However, even the recording material S that can be handled by the image forming apparatus 100 may be a recording material S that is not handled by the pressure sealing processing apparatus 200. For example, the recording material S in which the varnish applied to the surface easily permeates cannot secure a desired bonding force due to the varnish even though the image can be formed. Since there is a problem that the recording material S cannot be pressure-seal or is easily peeled off even though the recording material S can be pressure-seal, the pressure sealing processing apparatus 200 does not cope with this problem. Examples of the recording material S into which the varnish easily permeates include a recording material S (uncoated sheet) of which a surface is not coated. Even in the case of the recording material S on which the image can be formed, in a case where the recording material S has a relatively large grammage and has a relatively large thickness, since heating by the pressure sealing roller pair 601 is not sufficient, it is not possible to secure a desired bonding force by the varnish, and thus, the same problem may occur. Thus, in the present embodiment, in a case where the pressure-seal printed matter is created, the main controller 101 can decide whether to execute the pressure sealing of the recording material S in accordance with the type and grammage of the recording material S, and can control the operation of the pressure sealing processing apparatus 200 in accordance with the determination. This point will be described below.

Pressure-Seal Printed Matter Creating Process

The pressure-seal printed matter creating process according to a first embodiment will be described with reference to FIGS. 1 and 2 while referring to FIGS. 3 to 4B. The pressure-seal printed matter creating process according to the present embodiment is a procedure of which execution is started by the main controller 101 in accordance with the activation of the image forming system 1X.

Figure 3:
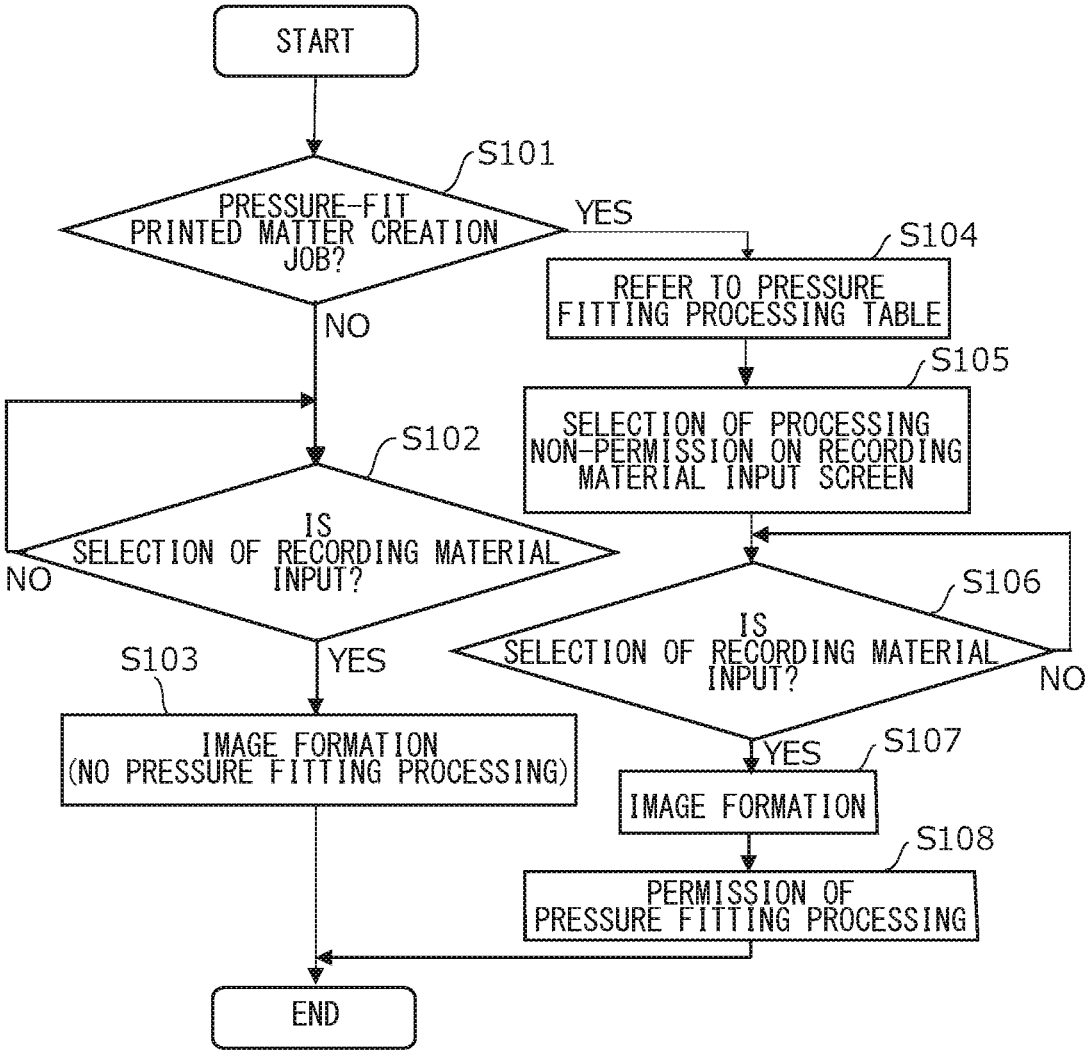
FIG. 3 is a flowchart illustrating a pressure-seal printed matter creating process according to a first embodiment.

As illustrated in FIG. 3, the main controller 101 determines whether the start input of any one of "image forming job" and "pressure-seal printed matter creation job" is performed from the operation unit 700 (S101). The main controller 101 puts the system in a waiting state until the start input of any one of "image forming job" and "pressure-seal printed matter creation job" is performed from the operation unit 700. In a case where the start input of "image forming job" is performed (NO in S101), the main controller 101 displays "recording material input screen" illustrated in FIG. 4A on the operation unit 700 and waits until the user performs a selection input of the recording material S (NO in S102).

Figure 4A:
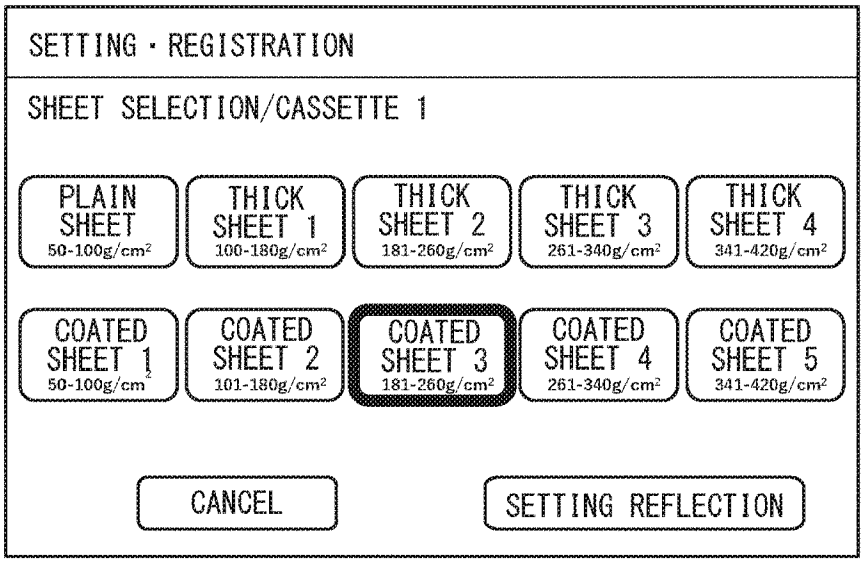

In a case where the start input of "image forming job" is performed, that is, in a case where the pressure sealing processing of the recording material S is not performed, as illustrated in FIG. 4A, the recording material S that is housed in the cassette 10, a sheet feeding apparatus (not illustrated), or the like and can be handled by the image forming apparatus 100 is displayed to be selectable on "recording material input screen". Here, a plurality of software keys indicating "plain sheet" (uncoated sheet), "thick sheets 1 to 4" (uncoated sheets) having different grammages, and "coated sheets 1 to 5" (coated sheets) having different grammages is displayed as the recording material S that can be handled by the image forming apparatus 100. The user can touch and select any one of the software keys indicating the recording material S displayed on "recording material input screen", and the selected recording material S is input as an image forming target by the image forming apparatus 100. Here, a case where "coated sheet 3" is selected is illustrated as an example, and in order to indicate to the user that "coated sheet 3" is selected, a display mode of "coated sheet 3" is different from that of other unselected recording materials S as illustrated in the drawing.

Referring back to the description of FIG. 3, in a case where the recording material S is selected on "recording material input screen" illustrated in FIG. 4A (YES in S102), the main controller 101 controls the image forming apparatus 100 to form the image on the selected recording material S (S103). In this case, the main controller 101 does not transmit the operation command to the pressure sealing processing apparatus 200 while controlling the operation of the image forming apparatus 100. Thus, the image is formed on the recording material S, but the pressure sealing processing of the recording material S is not performed. That is, the recording material S on which the image is formed is simply output, and the pressure-seal printed matter is not created.

Figure 4B:
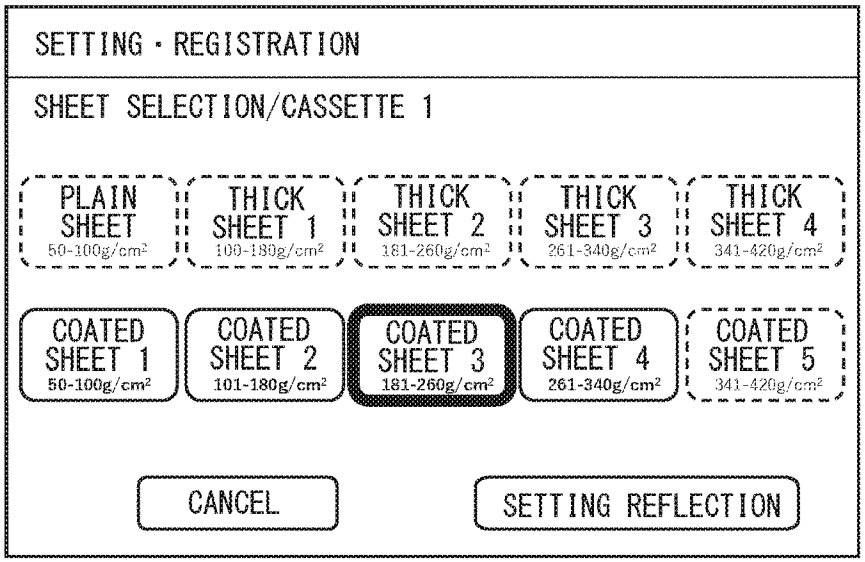

On the other hand, in a case where the start input of "pressure-seal printed matter creation job" is performed (YES in S101), the main controller 101 refers to the pressure sealing processing table (Table 1) stored in the ROM 103 (S104), and displays "recording material input screen" illustrated in FIG. 4B on the operation unit 700 (S105). The main controller 101 waits until the user performs the selection input of the recording material S (NO in S106).

TABLE 1

| | UV VARNISH PROCESSING MACHINE | FOLDING PROCESSING MACHINE | PRESSURE FITTING PROCESSING MACHINE | UPPER ROLLER TEMPERATURE (° C.) | LOWER ROLLER TEMPERATURE (° C.) | CONVEYANCE SPEED (mm/s) |
|---|---|---|---|---|---|---|
| PLAIN SHEET | x | | | | | |
| THICK SHEET | x | | | | | |
| COATED SHEET 1 (50-100 g/cm$^2$) | ○ | ○ | ○ | 170 | — | 350 |
| COATED SHEET 2 (101-180 g/cm$^2$) | ○ | ○ | ○ | 180 | — | 350 |
| COATED SHEET 3 (181-260 g/cm$^2$) | ○ | ○ | ○ | 190 | — | 350 |
| COATED SHEET 4 (261-340 g/cm$^2$) | ○ | ○ | ○ | 190 | 190 | 200 |
| COATED SHEET 5 (341-420 g/cm$^2$) | ○ | ○ | x | | | |

As represented in Table 1, in the pressure sealing processing table (data), whether the pressure sealing processing apparatus 200 can handle or cannot handle each recording material S is defined. In Table 1, the recording material S that can be handled is represented by "circle", and the non-handled recording material S that cannot be handled is represented by "cross". Accordingly, in this example, "plain sheet", "thick sheet" (uncoated sheet), and "coated sheet 5" are the recording materials S that cannot be handled by the pressure sealing processing apparatus 200, and "coated sheets 1 to 4" having grammages smaller than that of "coated sheet 5" are the recording materials S that can be handled by the pressure sealing processing apparatus 200. Specifically, "plain sheet" and "thick sheet" which are uncoated sheets of which surfaces are not coated are the recording materials S that cannot be handled by the adhesive application device 300 that applies the varnish since the varnish easily permeates. Since heat is not sufficiently transmitted at the time of heating by the pressure sealing roller pair 601 due to a thickness of the coated sheet and a desired bonding force by the varnish cannot be secured, "coated sheet 5" is the recording material S that cannot be handled by the pressure sealing device 600.

The adhesive application device 300, the folding processing device 400, and the pressure sealing device 600 may store, as data, the recording material S that can be handled by each device in the ROM 332, the ROM 432, and the ROM 632, respectively. In that case, the main controller 101 can obtain each data from the adhesive application device 300, the folding processing device 400, and the pressure sealing device 600, create the pressure sealing processing table as described above, store the table in the ROM 103 or the RAM 104, and use the table. This is advantageous because the pressure sealing processing table is automatically updated, for example, in a case where the adhesive application device 300, the folding processing device 400, and the pressure sealing device 600 are replaced with a new model with higher performance.

As illustrated in FIG. 4B, the recording material S that can be handled by the pressure sealing processing apparatus 200 is displayed to be selectable on "recording material input screen" displayed in a case where the start input of "pressure-seal printed matter creation job" is performed, that is, in a case where the pressure sealing processing of the recording material S is performed, in accordance with the pressure sealing processing table. Here, "coated sheets 1 to 4" are displayed to be selectable as the recording material S that can be handled by the pressure sealing processing apparatus 200 in accordance with the pressure sealing processing table of Table 1. In the case of the present embodiment, a display mode of a selectable recording material S and a display mode of a non-selectable recording material S are different. The user can touch and select any one of "coated sheets 1 to 4", but cannot touch and select any one of "plain sheet", "thick sheet", and "coated sheet 5". Here, a case where "coated sheet 3" is selected is illustrated as an example, and in order to indicate to the user that "coated sheet 3" is selected, a display mode such as a color of "coated sheet 3" is different from a display mode of a software key indicating another recording material S that is not selected as illustrated in the drawing.

Referring back to the description of FIG. 3, in a case where the recording material S is selected on "recording material input screen" illustrated in FIG. 4B (YES in S106), the main controller 101 controls the image forming apparatus 100 to form the image on the selected recording material S (S107). The main controller 101 transmits the operation command to the pressure sealing processing apparatus 200 (S108). That is, in the present embodiment, the selectable recording material S is selected on "recording material input screen" illustrated in FIG. 4B by a touch operation, and thus, the execution of the pressure sealing processing of the recording material S by the pressure sealing processing apparatus 200 is permitted. In a case where the execution of the pressure sealing processing of the recording material S by the pressure sealing processing apparatus 200 is permitted, a series of processes from image formation to pressure sealing on the recording material S is performed by the image forming apparatus 100 and the pressure sealing processing apparatus 200, and the pressure-seal printed matter is created.

Conversely, even though the touch operation is performed on the non-selectable recording material S on "recording material input screen" illustrated in FIG. 4B, the execution of the pressure sealing processing of the recording material S by the pressure sealing processing apparatus 200 is not permitted. In other words, in the case of the recording material S for which the execution of the pressure sealing processing by the pressure sealing processing apparatus 200 is not permitted, the input of the recording material S is accepted and the execution is not permitted by setting the recording material S to be non-selectable on "recording material input screen" illustrated in FIG. 4B.

In a case where the execution of the pressure sealing processing of the recording material S by the pressure sealing processing apparatus 200 is permitted, the main controller 101 changes the target temperature of the heater 602 and the target speed of the recording material S (the rotational speed of the motor 634) to values corresponding to the recording material S in accordance with the pressure sealing processing table of Table 1. For example, in the case of "coated sheet 1" of which a grammage is a first grammage (50 to 100 g/cm$^2$), the temperature of the upper roller 601*a* is set to a first temperature (170° C.). In the case of "coated sheet 2" of which a grammage is a second grammage (101 to 180 g/cm$^2$) larger than the first grammage, the temperature of the upper roller 601*a* is set to a second temperature (180° C.) higher than the first temperature. In the case of "coated sheet 3" of which a grammage is the first grammage (181 to 260 g/cm$^2$), a conveyance speed of the recording material S is set to a first speed (350 mm/s). In the case of "coated sheet 4" of which a grammage is the second grammage (261 to 340 g/cm$^2$) larger than the first grammage, the conveyance speed of the recording material S is set to a second speed (200 mm/s) slower than the first speed.

As described above, in the present embodiment, in the case of the configuration in which the pressure-seal printed matter by pressure-sealing the recording material S after the image is formed, whether to execute the pressure sealing processing is decided in accordance with the type and grammage of the recording material S, and the operation of the pressure sealing processing apparatus 200 can be controlled. Accordingly, the non-handled recording material S that can cause an error, a pressure sealing failure, or the like in the pressure sealing processing apparatus 200 is not conveyed to the pressure sealing processing apparatus 200. Accordingly, it is possible to provide the image forming system 1X in which the user can easily perform the series of processes from the image formation to the pressure sealing with the configuration in which the pressure sealing processing apparatus 200 is connected to the image forming apparatus 100, and thus, it is possible to improve work efficiency for creating the pressure-seal printed matter.

Second Embodiment

Pressure-Seal Printed Matter Creating Process

Next, a pressure-seal printed matter creating process according to a second embodiment will be described with reference to FIGS. 5 to 8 while referring to FIGS. 1 and 2. The pressure-seal printed matter creating process according to the present embodiment is a procedure of which execution is started by the main controller 101 as the image forming system 1X is powered on.

Figure 5:
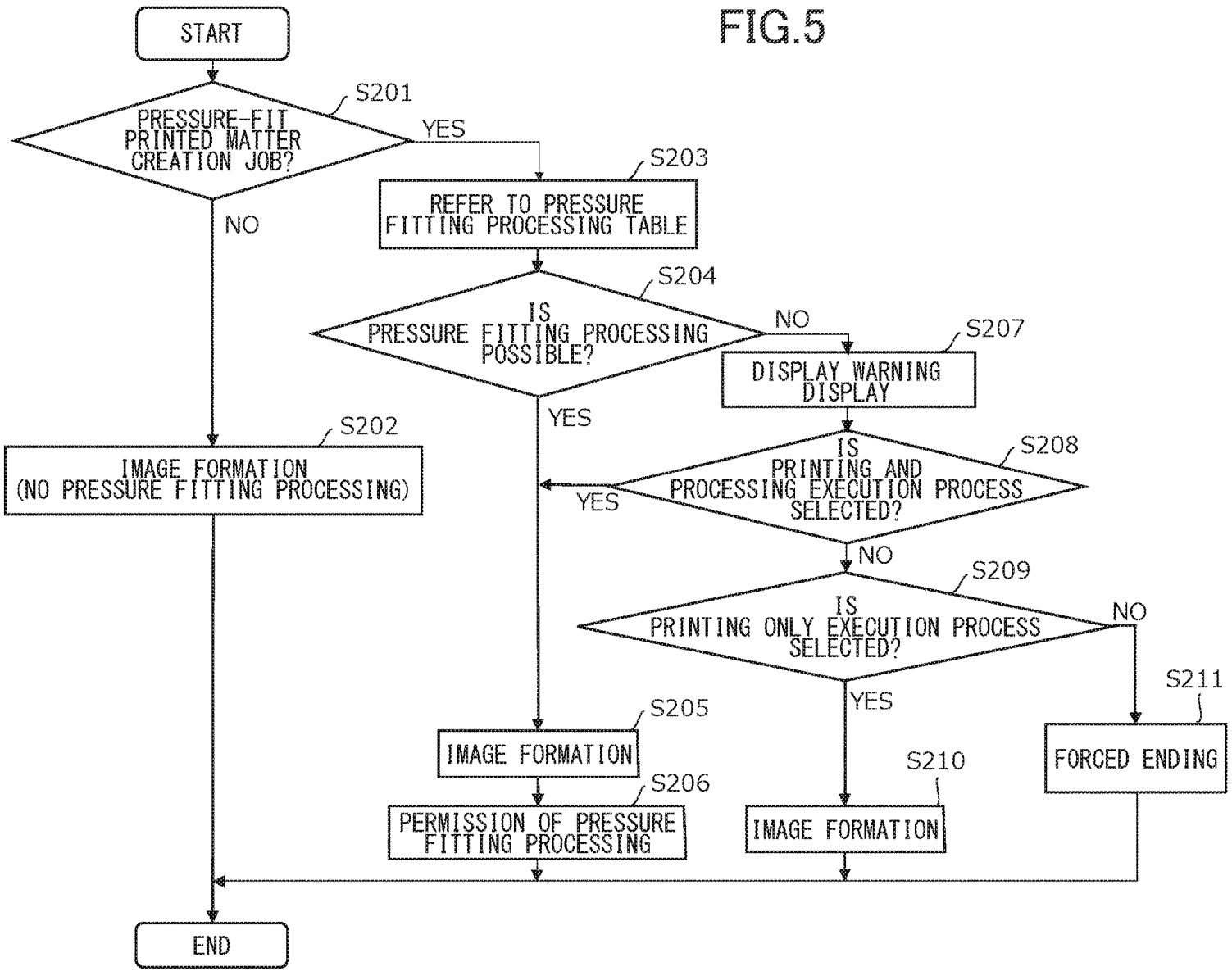
FIG. 5 is a flowchart illustrating a pressure-seal printed matter creating process according to a second embodiment.

As illustrated in FIG. 5, the main controller 101 determines whether the start input of any one of "image forming job" and "pressure-seal printed matter creation job" is performed from the operation unit 700 (S201). In the case of the present embodiment, the recording material S is selected from "recording material input screen" illustrated in FIG. 4A regardless of whether the start input of any one of "image forming job" and "pressure-seal printed matter creation job" is performed. The main controller 101 puts the system in the waiting state until the selection of the recording material S from the operation unit 700 and the start input of any one of "image forming job" and "pressure-seal printed matter creation job" is performed.

In a case where the start input of the "image forming job" is performed (NO in S201), the main controller 101 controls the image forming apparatus 100 to form the image on the recording material S selected together with the start input of "image forming job" (S202). In this case, the main controller 101 does not transmit the operation command to the pressure sealing processing apparatus 200 while controlling the operation of the image forming apparatus 100. Thus, the image is formed on the recording material S, but the pressure sealing processing of the recording material S is not performed. That is, the recording material S on which the image is formed is simply output, and the pressure-seal printed matter is not created.

In a case where the start input of "pressure-seal printed matter creation job" is performed (YES in S201), the main controller 101 collates the pressure sealing processing table (Table 1) stored in the ROM 103 with the recording material S selected together with the start input of "pressure-seal printed matter creation job" (S203). The main controller 101 determines whether the selected recording material S is the recording material S that can be handled by the pressure sealing processing apparatus 200 (S204).

In a case where the selected recording material S is the recording material S that can be handled by the pressure sealing processing apparatus 200 (YES in S204), the main controller 101 controls the image forming apparatus 100 to form the image on the selected recording material S (S205). The main controller 101 transmits the operation command to the pressure sealing processing apparatus 200 (S206). Thus, in the present embodiment, it is automatically determined whether the selected recording material S is the recording material S that can be handled by the pressure sealing processing apparatus 200, and the execution of the pressure sealing processing of the recording material S by the pressure sealing processing apparatus 200 is permitted in accordance with the determination result. In a case where the execution of the pressure sealing processing of the recording material S by the pressure sealing processing apparatus 200 is permitted, a series of processes from image formation to pressure sealing on the recording material S is performed by the image forming apparatus 100 and the pressure sealing processing apparatus 200, and the pressure-seal printed matter is created.

On the other hand, in a case where the selected recording material S is not the recording material S that can be handled by the pressure sealing processing apparatus 200 (NO in S204), the main controller 101 displays "warning screen" illustrated in FIG. 6 on the operation unit 700 and waits (S207). As illustrated in FIG. 6, "warning screen" is a screen that displays that the selected recording material S is not the recording material S that can be handled by the pressure sealing processing apparatus 200 and that allows the user to select a process for the selected recording material S. As the process for the recording material S, the user can select any one of a "printing and processing execution" process, a "printing only execution" process, and a "canceling" process. The "printing and processing execution" process is a process of forcibly performing the pressure sealing processing of the recording material S even though the recording material S is not the recording material S that can be handled by the pressure sealing processing apparatus 200. The "printing only execution" process is a process of performing only the image formation by the image forming apparatus 100 since the recording material S is not handled by the pressure sealing processing apparatus 200. The "canceling" process is a process of forcibly ending (stopping) the input "pressure-seal printed matter creation job" and performing neither the image formation nor the pressure sealing processing. The main controller 101 executes a process selected by the user according to "warning screen" displayed on the operation unit 700.

In a case where the user selects the "printing and processing execution" process (YES in S208), the main controller 101 controls the image forming apparatus 100 to form the image on the selected recording material S (S205). The main controller 101 transmits the operation command to the pressure sealing processing apparatus 200 (S206). In this case, since the execution of the pressure sealing processing of the recording material S by the pressure sealing processing apparatus 200 is permitted, the pressure-seal printed matter can be created by performing the series of processes from the image formation to the pressure sealing on the recording material S. However, since the selected recording material S is not the recording material S that can be handled by the pressure sealing processing apparatus 200, there is a concern that an error, a pressure sealing failure, or the like occurs in the pressure sealing processing apparatus 200 in some cases. However, since there is a case where it is desired to create only one pressure-seal printed matter on a trial basis, the pressure-seal printed matter can be selected in such a case.

In a case where the user selects the "printing only execution" process (NO in S208 and YES in S209), the main controller 101 controls the image forming apparatus 100 to form the image on the selected recording material S (S210). The main controller 101 displays "print execution screen" illustrated in FIG. 7 on the operation unit 700. In this case, the main controller 101 does not transmit the operation command to the pressure sealing processing apparatus 200 while controlling the operation of the image forming apparatus 100. Thus, the image is formed on the recording material S, but the pressure sealing processing of the recording material S is not performed. That is, the recording material S on which the image is formed is simply output, and the pressure-seal printed matter is not created. Since the selected recording material S is not the recording material S that can be handled by the pressure sealing processing apparatus 200 on "print execution screen" illustrated in FIG. 7, the fact that the pressure sealing processing is not performed on the recording material S and the image formation is performed is displayed.

In a case where the user selects the "printing only execution" process, the recording material S on which the image is formed by the image forming apparatus 100 may be sent to the sheet discharge tray 950 (escape tray) provided in the image forming apparatus 100 without being sent to the pressure sealing processing apparatus 200. In such a case, the fact that the recording material S on which "printing only execution" is performed is discharged to the sheet discharge tray 950 may be displayed on "print execution screen".

In a case where the user selects the "canceling" process (NO in S208 and NO in S209), the main controller 101 forcibly ends "pressure-seal printed matter creation job" and does not perform the image formation nor the pressure sealing processing (S211). The main controller 101 displays "forced ending screen" illustrated in FIG. 8 on the operation unit 700. Since the selected recording material S is not the recording material S that can be handled by the pressure sealing processing apparatus 200 on "forced ending screen" illustrated in FIG. 8, the fact that "pressure-seal printed matter creation job" is forcibly ended without performing the pressure sealing processing or the image formation on the recording material S is displayed.

As described above, in the present embodiment, it is also possible to provide the image forming system 1X in which the user can easily perform the series of processes from the image formation to the pressure sealing, and it is also possible to obtain the same effect as that of the above-described first embodiment that the work efficiency for creating the pressure-seal printed matter can be improved.

Other Embodiments

Figure 9:
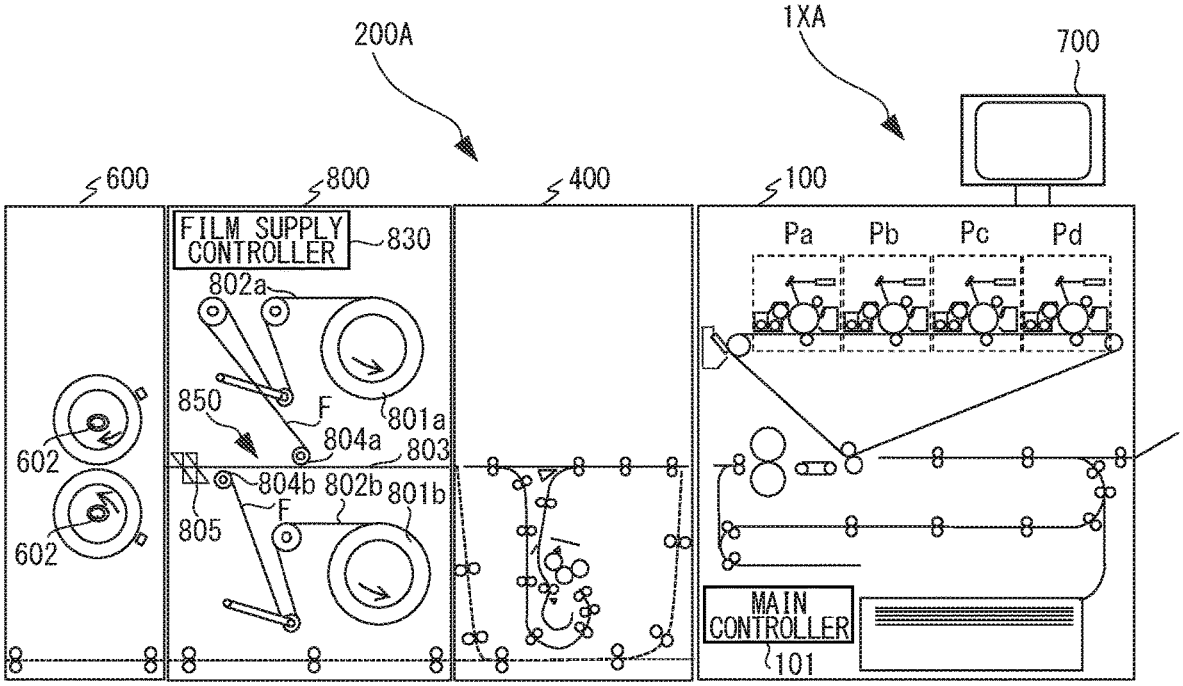
FIG. 9 is a schematic diagram illustrating another embodiment of the image forming system.

In the above-described embodiment, the example in which the adhesive application device 300 (varnish machine) using the ultraviolet curable varnish (UV varnish) is adopted in order to perform pseudo bonding of the recording material S has been described. However, the present invention is not limited thereto, and a film supply device (film machine) using a bonding film may be adopted. FIG. 9 illustrates an image forming system 1XA adopting the film supply device 800. In FIG. 9, the same components as those of the image forming system 1X illustrated in FIG. 1 are denoted by the same reference signs, and the description thereof will be simplified or omitted.

As illustrated in FIG. 9, unlike the above-described image forming system 1X (see FIG. 1), the image forming system 1XA includes a pressure sealing processing apparatus 200A that includes the folding processing device 400, a film supply device 800, and the pressure sealing device 600. That is, the pressure sealing processing apparatus 200A includes the folding processing device 400 that folds the recording material S on which the image is formed, the film supply device 800 that supplies a heat-sensitive bonding film F to the inside of the folded recording material S, and the pressure sealing device 600 that applies heat and pressure to the folded recording material S. The adhesive application device 300 (see FIG. 1) delivers the recording material S from the image forming apparatus 100 and conveys the recording material to the folding processing device 400, but the film supply device 800 delivers the recording material S from the folding processing device 400 and conveys the recording material to the pressure sealing device 600.

Film Supply Device

The film supply device 800 as a supply unit includes a film supply controller 830, film rolls 801*a* and 801*b* around which the bonding film F is wound, and a film supply unit 850 that supplies the bonding film F to the recording material S. The film supply controller 830 mainly controls the film supply unit 850. The bonding film F is, for example, a film on which an adhesive layer that causes a bonding force by applying heat and pressure to front and back surfaces of two transparent films bonded together is formed.

The long bonding film F wound around the film rolls 801*a* and 801*b* is sequentially supplied along predetermined film supply paths 802*a* and 802*b*. In a case where the recording material S folded in three reaches intersection regions 804*a* and 804*b* between the conveyance path 803 and the film supply paths 802*a* and 802*b*, the bonding film F is supplied so as to be sandwiched by the recording material S. Thereafter, the bonding film F is cut into a desired size by a cutting member 805. On the other hand, in a case where the recording material S folded in two reaches an intersection region 804*a* between the conveyance path 803 and the film supply path 802*a*, the bonding film F is supplied so as to be sandwiched by the recording material S. Thereafter, the bonding film F is cut into a desired size by the cutting member 805.

Figure 10:
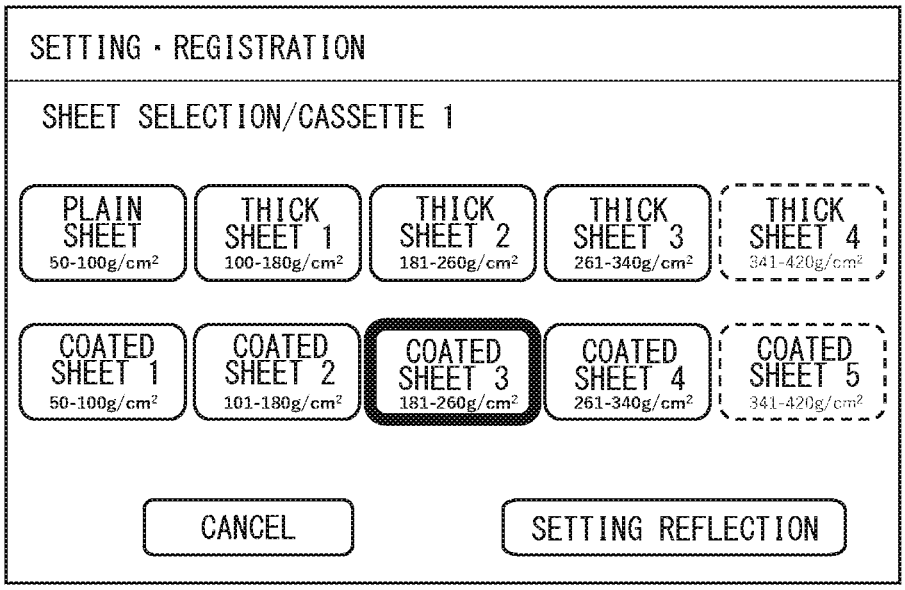
FIG. 10 is a diagram illustrating a recording material input screen in a case where pressure sealing processing is performed in the image forming system illustrated in FIG. 9.

In the case of such an image forming system 1XA, the main controller 101 can perform the above-described pressure-seal printed matter creating process (see FIG. 3). However, the recording material S that can be handled by the pressure sealing processing apparatus 200 of the image forming system 1X is different from the recording material S that can be handled by the pressure sealing processing apparatus 200A of the image forming system 1XA. Thus, in the case of the image forming system 1XA, the main controller 101 can perform processing such as displaying "recording material input screen" illustrated in FIG. 10 on the operation unit 700 in accordance with Table 2 to be represented below instead of Table 1 (see S105 in FIG. 3).

TABLE 2

| | FILM CORRESPONDENCE | FOLDING PROCESSING MACHINE | PRESSURE FITTING PROCESSING MACHINE | UPPER ROLLER TEMPERATURE (° C.) | LOWER ROLLER TEMPERATURE (° C.) | CONVEYANCE SPEED (mm/s) |
|---|---|---|---|---|---|---|
| PLAIN SHEET (50-100 g/cm$^2$) | ○ | ○ | ○ | 100 | 100 | 350 |
| THICK SHEET 1 (100-180 g/cm$^2$) | ○ | ○ | ○ | 150 | 150 | 350 |
| THICK SHEET 2 (181-260 g/cm$^2$) | ○ | ○ | ○ | 170 | 170 | 350 |
| THICK SHEET 3 (261-340 g/cm$^2$) | ○ | ○ | ○ | 190 | 190 | 200 |
| THICK SHEET 4 (341-420 g/cm$^2$) | ○ | ○ | x | | | |
| COATED SHEET 1 (50-100 g/cm$^2$) | ○ | ○ | ○ | 100 | 100 | 350 |
| COATED SHEET 2 (101-180 g/cm$^2$) | ○ | ○ | ○ | 150 | 150 | 350 |
| COATED SHEET 3 (181-260 g/cm$^2$) | ○ | ○ | ○ | 170 | 170 | 350 |
| COATED SHEET 4 (261-340 g/cm$^2$) | ○ | ○ | ○ | 190 | 190 | 200 |
| COATED SHEET 5 (341-420 g/cm$^2$) | ○ | ○ | x | | | |

As illustrated in Table 2, in the pressure sealing processing table (data), whether the pressure sealing processing apparatus 200A can handle or cannot handle each recording material S is defined. In Table 2, the recording material S that can be handled is represented by "circle", and the non-handled recording material S that cannot be handled is represented by "cross". In this case, in a case where the grammage of the recording material S is equal to or more than a predetermined value (here, 341 g/cm$^2$), the main controller 101 determines that the recording material S is not the recording material S that can be handled by the pressure sealing processing apparatus 200A regardless of whether the recording material S is the uncoated sheet such as "plain sheet" or "thick sheet" or "coated sheets 1 to 5". In the case of the recording material S having a grammage of a predetermined value or more, since heat is not sufficiently transmitted at the time of heating by the pressure sealing roller pair 601 due to the thickness thereof and a desired bonding force by the bonding film cannot be secured, the recording material S cannot be handled by the pressure sealing device 600. In the case of such a recording material S, the main controller 101 does not permit execution of the pressure sealing processing of the recording material S by the pressure sealing processing apparatus 200A.

In a case where the execution of the pressure sealing processing of the recording material S by the pressure sealing processing apparatus 200A is permitted, the main controller 101 changes the target temperature of the heater 602 and the target speed of the recording material S (the rotational speed of the motor 634) to values corresponding to the recording material S in accordance with the pressure sealing processing table of Table 2.

In the above-described embodiment, the example in which the above-described pressure-seal printed matter creating process (FIGS. 3 and 5) is executed by the main controller 101 has been described, but the present invention is not limited thereto, and any one of the controllers included in the pressure sealing processing apparatus 200 (200A) may execute the process. Alternatively, in the case of the image forming system 1X including an external controller as the external device 900, the external controller may control the main controller 101, the varnish processing controller 330 (or the film supply controller 830), the folding processing controller 430, and the pressure sealing processing controller 630. In this case, the external controller controls all the image forming apparatus 100, the pressure sealing processing apparatus 200, the adhesive application device 300 (film supply device 800), the folding processing device 400, and the pressure sealing device 600 via the controllers, and executes the above-described pressure-seal printed matter creating process (FIGS. 3 and 5).

The controller that controls the image forming system 1X may be provided in any casing as long as the above-described pressure-seal printed matter creating process is executed. For example, the controller that controls the entire image forming system 1X may be the main controller 101 or the external controller described above or may be provided inside any device of the pressure sealing processing apparatus 200, and may be configured to execute the above-described pressure-seal printed matter creating process (FIGS. 3 and 5).

In the above-described embodiment, although the image forming system 1X in which the pressure sealing processing apparatus 200 is connected as a different casing to the outside of the apparatus body of the image forming apparatus 100 has been described as an example, the pressure sealing processing apparatus 200 may be provided in the apparatus body (in the same casing) of the image forming apparatus 100. In this case, the main controller 101 also operates as the varnish processing controller 330 (or the film supply controller 830), the folding processing controller 430, and the pressure sealing processing controller 630 described above.

According to the present embodiment, it is possible to easily and continuously perform the processes from the image formation to the pressure sealing on the recording material without interruption, and thus, it is possible to improve the work efficiency for creating the pressure-seal printed matter.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-183686, filed Nov. 2, 2020, which is hereby incorporated by reference herein in its entirety.

What is claimed is:

1. An image forming system comprising:

an image forming apparatus configured to form an image on a recording material;

a pressure sealing processing apparatus configured to execute a pressure sealing processing process of pressure-sealing the recording material by folding the recording material on which the image is formed by the image forming apparatus and applying pressure to the folded recording material; and a control unit configured to control the image forming apparatus and the pressure sealing processing apparatus, wherein the control unit is configured to permit execution of the pressure sealing processing process by the pressure sealing processing apparatus on a recording material of which a grammage is smaller than a predetermined grammage, and is configured not to permit execution of the pressure sealing processing process by the pressure sealing processing apparatus on a recording material of which a grammage is equal to or more than the predetermined grammage.

2. The image forming system according to claim 1, further comprising an input unit configured to accept an instruction from a user based on an input operation by the user, wherein the control unit is configured to control the input unit such that a selection input of the recording material of which the grammage is equal to or more than the predetermined grammage from the input unit is not permitted in a case where the pressure sealing processing process is included in the instruction from the user that is accepted via the input unit.

3. The image forming system according to claim 1, further comprising an input unit configured to accept an instruction from a user based on an input operation by the user, wherein the control unit is configured not to permit execution of the pressure sealing processing process by the pressure sealing processing apparatus in a case where an instruction to perform the pressure sealing processing process on the recording material of which the grammage is equal to or more than the predetermined grammage is included in the instruction from the user that is accepted via the input unit.

4. The image forming system according to claim 3, wherein the input unit includes a display unit that displays information, and the control unit is configured to perform warning display on the display unit in a case where the instruction to perform the pressure sealing processing process on the recording material of which the grammage is equal to or more than the predetermined grammage is included in the instruction from the user that is accepted via the input unit.

5. The image forming system according to claim 4, wherein the control unit is configured to control the display unit so as to display, as the warning display, information for accepting cancelation of the instruction from the user which is accepted via the input unit.

6. The image forming system according to claim 4, wherein the control unit is configured to control the display unit to display, as the warning display, information for accepting only image formation by the image forming apparatus based on the instruction from the user that is accepted via the input unit.

7. The image forming system according to claim 1, wherein the pressure sealing processing apparatus includes:

an application unit configured to apply varnish on a surface of the recording material on which the image is formed by the image forming apparatus, a folding unit configured to fold the recording material in a state in which the surface on which the varnish is applied by the application unit faces inward, and a pressure sealing unit configured to apply pressure to the recording material folded by the folding unit.

8. The image forming system according to claim 1, wherein the pressure sealing processing apparatus includes:

a folding unit configured to fold the recording material on which the image is formed by the image forming apparatus, a supply unit configured to supply a heat-sensitive bonding film on an inside of the folded recording material, and a pressure sealing unit configured to apply heat and pressure on the recording material in a state of being folded by the folding unit to sandwich the bonding film supplied by the supply unit.

9. An image forming system comprising:

an image forming apparatus configured to form an image on a recording material;

a pressure sealing processing apparatus that includes an application unit which applies varnish on the recording material on which the image is formed by the image forming apparatus, a folding unit that folds the recording material in a state in which a surface on which the varnish is applied by the application unit faces inward, and a pressure sealing unit that applies pressure to the folded recording material, and is configured to execute a pressure sealing processing process on the recording material on which the image is formed by the image forming apparatus; and a control unit configured to control the image forming apparatus and the pressure sealing processing apparatus, wherein the control unit is configured to permit execution of the pressure sealing processing process by the pressure sealing processing apparatus on a recording material of which a surface is coated, and is configured not to permit execution of the pressure sealing processing process by the pressure sealing processing apparatus on a recording material of which a surface is not coated.

10. The image forming system according to claim 9, wherein the control unit is configured to permit execution of the pressure sealing processing process by the pressure sealing processing apparatus on a recording material of which a surface is coated and a grammage is smaller than a predetermined grammage, and is configured not to permit execution of the pressure sealing processing process by the pressure sealing processing apparatus on a recording material of which a surface is coated and a grammage is equal to or more than the predetermined grammage.

11. The image forming system according to claim 9, further comprising an input unit configured to accept an instruction from a user based on an input operation by the user, wherein the control unit is configured to control the input unit such that a selection input of the recording material of which the surface is not coated from the input unit is not permitted in a case where the pressure sealing processing process is included in the instruction from the user which is accepted via the input unit.

12. The image forming system according to claim 9, further comprising an input unit configured to accept an instruction from a user based on an input operation by the user, wherein the control unit is configured not to permit execution of the pressure sealing processing process by the pressure sealing processing apparatus in a case where an instruction to perform the pressure sealing processing process on the recording material of which the surface is not coated is included in the instruction from the user that is accepted via the input unit.

13. The image forming system according to claim 12, wherein the input unit includes a display unit that displays information, and the control unit configured to perform warning display on the display unit in a case where an instruction to perform the pressure sealing processing process on the recording material of which the surface is not coated is included in the instruction from the user that is accepted via the input unit.

14. The image forming system according to claim 13, wherein the control unit is configured to control the display unit to display, as the warning display, information for accepting cancelation of the instruction from the user that is accepted via the input unit.

15. The image forming system according to claim 13, wherein the control unit is configured to control the display unit to display, as the warning display, information for accepting only image formation by the image forming apparatus based on the instruction from the user that is accepted via the input unit.

16. The image forming system according to claim 6, wherein the image forming apparatus includes a sheet discharge tray, and the control unit is configured to discharge the recording material on which the image is formed by the image forming apparatus to the sheet discharge tray without conveying the recording material on which the image is formed by the image forming apparatus to the pressure sealing processing apparatus in a case where only image formation by the image forming apparatus is accepted based on the instruction from the user.

17. The image forming system according to claim 13, wherein the image forming apparatus includes a sheet discharge tray, and the control unit is configured to discharge the recording material on which the image is formed by the image forming apparatus to the sheet discharge tray without conveying the recording material on which the image is formed by the image forming apparatus to the pressure sealing processing apparatus in a case where only image formation by the image forming apparatus is accepted based on the instruction from the user.

18. The image forming system according to claim 1, further comprising an external device connected to be able to input and output data to the image forming apparatus, wherein the control unit is provided in the external device.

19. The image forming system according to claim 9, further comprising an external device connected to be able to input and output data to the image forming apparatus, wherein the control unit is provided in the external device.

* * * * *